US006246299B1

(12) United States Patent
Werlau

(10) Patent No.: US 6,246,299 B1
(45) **Date of Patent: *Jun. 12, 2001**

(54) HIGH POWER BROADBAND COMBINER HAVING FERRITE CORES

(75) Inventor: Bernard J. Werlau, Patterson, NY (US)

(73) Assignee: Werlatone, Inc., Brewster, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/358,166

(22) Filed: Jul. 20, 1999

(51) Int. Cl.[7] ..... H01P 5/12
(52) U.S. Cl. ..... 333/127; 333/26
(58) Field of Search ..... 333/127, 136, 333/130, 131, 22, 26

(56) References Cited

U.S. PATENT DOCUMENTS

| | | | |
|---|---|---|---|
| 4,182,996 | 1/1980 | Spence | 333/100 |
| 4,309,666 | 1/1982 | Ito et al. | 330/286 |
| 4,605,902 | 8/1986 | Harrington | 328/158 |
| 4,647,868 | 3/1987 | Mueller | 330/286 |
| 4,774,481 | 9/1988 | Edwards et al. | 333/127 |
| 4,916,410 | 4/1990 | Littlefield | 330/295 |
| 5,017,886 | 5/1991 | Geller | 330/277 |
| 5,982,252 * | 11/1999 | Werlau | 333/127 |

* cited by examiner

*Primary Examiner*—Robert Pascal
*Assistant Examiner*—Kimberly E Glenn
(74) *Attorney, Agent, or Firm*—St. Onge Steward Johnston & Reens LLC

(57) ABSTRACT

A signal combiner assembly having a common ground plane and first and second coaxial cable connectors is provided. Each of the first and second coaxial cable connectors includes an inner conductor and an outer conductor, the outer conductors being connected to the common ground plane. First and second coaxial cables, each having an inner conductor and an outer conductor, are also provided. The inner conductor of the first coaxial cable extends between the inner conductor of the first coaxial cable connector and a sum port, while the inner conductor of the second coaxial cable extends between the inner conductor of the second coaxial cable connector and the sum port. The first and second coaxial cables passing through a hole provided in a piece of magnetic material from opposite sides of the hole. Preferably, the piece of magnetic material is formed from a ferrite and takes the shape of a toroid or squaroid.

21 Claims, 2 Drawing Sheets

HIGH POWER BROADBAND COMBINER HAVING FERRITE CORES

FIELD OF THE INVENTION

The present invention relates to a signal combiner, and more particularly to a high power broadband non-directional signal combiner for use with coherent and non-coherent solid state power amplifiers.

BACKGROUND OF THE INVENTION

The development of solid-state power amplifiers for RF transmitters has created challenges to designers not present when using previous tube designs. One major problem with solid-state designs is their limited power handling capability. While high power devices have been developed, they are generally quite expensive and thus are not desirable for designs where cost is a significant factor.

One strategy for solving this dilemma has been to divide the signal to be amplified into several components and to direct these components to a like number of smaller solid-state power amplifiers. The outputs of the power amplifiers are then combined to provide an output signal level which is comparable to or higher than the output signal which could have been obtained from a single high power solid-state power amplifier.

This divide-and-conquer strategy has its own drawbacks, however. The primary drawback was that previous signal dividers and combiners had used conventional wound transformers and lumped inductive and capacitive components to achieve the required impedance matching. Such components are inherently narrow-banded and are thus impractical for applications where wide bandwidths are required. Modern solid-state power amplifiers are generally broad-banded, and conventional narrow-banded signal dividers and combiners severely limited their utility.

One solution to such narrow-banded dividers and combiners was provided by U.S. Pat. No. 4,774,481 to Edwards et al., which discloses a broadband non-directional signal combiner (non-directional meaning that the combiner can be used as either a combiner or a divider). The combiner utilizes coaxial cables interconnected in a bridge configuration, and a coaxial cable transformer. The bridge configuration increases bandwidth, while the transformer counteracts the impedance transforming characteristics of the combiner. The resulting combiner disclosed by Edwards et al. combines and divides signals across a broad range of frequencies with relatively large isolation between input ports, and a low voltage standing wave ratio. However, the combiner disclosed in Edwards et al. is not entirely flux canceling when in the coherent mode. In addition, the combiner has a relatively large number of interconnections which act as discontinuities in the circuit, which increase insertion losses.

Another solution to the problems associated with narrow-banded dividers and combiners has been proposed in commonly assigned U.S. patent application Ser. No. 09/067,852. The combiner disclosed therein utilizes coaxial cables which are wound into coils. This arrangement provides a combiner having a relatively short signal path with few discontinuities, such that insertion losses are low and relatively little inductance is required in the signal path. However, this configuration may not be able to provide as high a bandwidth as may be desired, which may be up to 50:1 or higher for example.

What is still needed, therefore, is a non-directional signal combiner which exhibits exceptional power handling ability with low insertion loss characteristics, which exhibits excellent isolation characteristics between input ports, which exhibits excellent input and output port voltage standing wave ratio characteristics, which is capable of dissipating relatively large amounts of unbalanced power, which employs flux canceling circuitry combined with transmission line mode impedance matching which inherently exhibits excellent IMD characteristics, which exhibits a usable bandwidth of a decade or more and which is rugged and reliable, and of a relatively simple design that is conducive to relatively inexpensive mass production.

SUMMARY OF THE INVENTION

An object, therefore, of the present invention is to provide a non-directional signal combiner which exhibits exceptional power handling ability with low insertion loss characteristics.

Another object of the present invention is to provide a non-directional signal combiner having the above characteristics and which exhibits improved isolation characteristics between input ports.

Another object of the present invention is to provide a non-directional signal combiner having the above characteristics and which exhibits excellent input and output port voltage standing wave ratio characteristics.

An additional object of the present invention is to provide a non-directional signal combiner having the above characteristics and which is capable of dissipating relatively large amounts of unbalanced power.

A further object of the present invention is to provide a non-directional signal combiner having the above characteristics and which employs flux canceling circuitry combined with transmission line mode impedance matching which inherently exhibits excellent IMD characteristics.

Yet another object of the present invention is to provide a non-directional signal combiner having the above characteristics and which exhibits a usable bandwidth of a decade or more.

Still another object of the present invention to provide a non-directional signal combiner having the above characteristics and which is rugged and reliable, and of a relatively simple design that is conducive to relatively inexpensive mass production.

These and other objects of the present invention are achieved by a signal combiner assembly having a common ground plane and first and second coaxial cable connectors. Each of the first and second coaxial cable connectors includes an inner conductor and an outer conductor, the outer conductors being connected to the common ground plane. First and second coaxial cables, each having an inner conductor and an outer conductor, are also provided. The inner conductor of the first coaxial cable extends between the inner conductor of the first coaxial cable connector and a sum port, while the inner conductor of the second coaxial cable extends between the inner conductor of the second coaxial cable connector and the sum port. The first and second coaxial cables passing through a hole provided in a piece of magnetic material from opposite sides of the hole. Preferably, the piece of magnetic material is formed from a ferrite and takes the shape of a toroid or squaroid.

Preferably, the signal combiner assembly also includes third and fourth coaxial cables having an inner conductor and an outer conductor. The inner conductor of the third coaxial cable extends between a first end of the outer conductor of the first coaxial cable and a second end of the outer conductor of the second coaxial cable. Similarly, the inner conductor of the fourth coaxial cable extends between a first end of the outer conductor of the second coaxial cable and a second end of the outer conductor of the first coaxial cable. Both ends of the outer conductors of both cables are connected to the common ground plane.

The signal combiner assembly also preferably includes a first dissipater extending between the first ends of the outer conductors of the first and the second coaxial cables and a second dissipater extending between the second ends of the outer conductors of the first and the second coaxial cables. Most preferably, the first and the second dissipaters comprise resistors.

It is also preferable to provide grounded capacitors connected at the sum port and at each output port and with capacitors in parallel with the first and the second dissipaters 78. The capacitors compensate for any residual reactance within the combiner.

Other objects, advantages and novel features of the invention will become apparent from the following detailed description of the invention when considered in conjunction with the accompanying drawings.

DETAILED DESCRIPTION OF THE INVENTION

Figure 1:
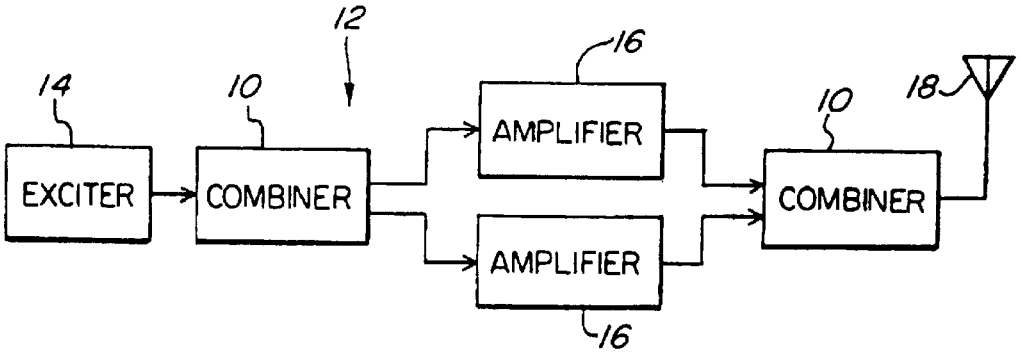
FIG. 1 is a block diagram of a radio frequency transmitter system utilizing two 2-way non-directional signal combiner assemblies according to the present invention.

Referring first to FIG. 1, a combiner assembly 10 according to the present invention may be utilized, for example, in a radio frequency transmitter system 12. The system 12 uses an exciter 14, or other device, for producing a modulated RF signal for transmission to a distant location. Exciter 14 is coupled to a first combiner assembly 10 in accordance with the present invention, which divides the signal into two components. The signal components are coupled respectively to RF power amplifiers 16, which amplify the signal components and provide the respective amplified signal components at outputs. The two amplified signal components are coupled to a second combiner assembly 10 in accordance with the present invention, which combines the two components. The amplified signal from the second combiner assembly can then be coupled to an antenna 18, or other transmission device, for transmission of the signal to a distant location.

Figure 2:
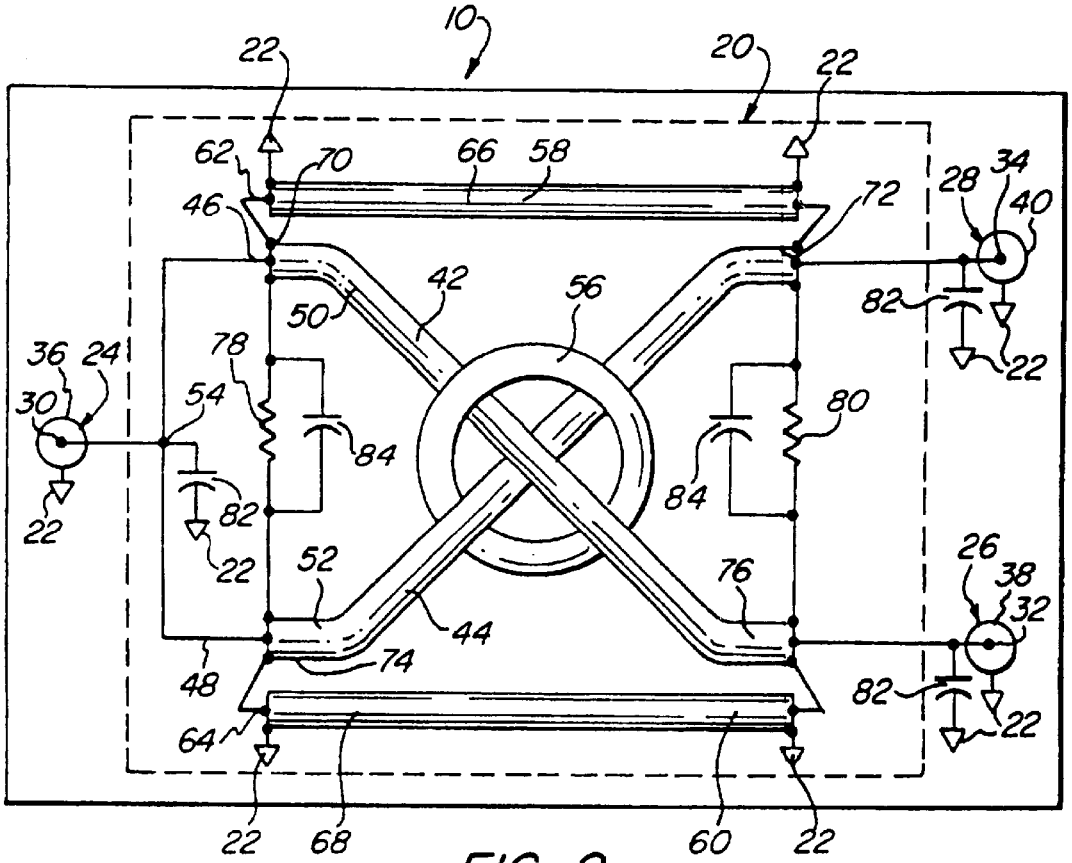
FIG. 2 is a schematic representation of the 2-way combiner assembly of FIG. 1.

Referring now to FIG. 2, a schematic representation of the combiner assembly 10 of FIG. 1 is shown. It should be understood that, although the combiner assembly may function either as a combiner or divider depending upon the manner of usage, for the sake of simplicity it will be referred to as a "non-directional combiner" with the understanding that both functions are included within that term. In addition, the terms "input" and "output" are interchangeable; and when one is referred to either the specification or the appended claims, the other is also included. Furthermore, although a 2-way non-directional combiner assembly is shown, it should be understood that a combiner assembly according to the present invention could include other appropriate numbers of input or output ports, with a 4-way embodiment being described below.

The combiner assembly 10 includes a non-directional combiner 20 for combining or dividing a signal, a common ground plane 22, an input port 24 and two output ports 26, 28. All of the ports 24, 26, 28 are preferably coaxial cable connectors having, respectively, inner conductors 30, 32, 34 and outer conductors 36, 38, 40 with the outer conductors connected to the common ground plane 22.

The combiner 20 includes first and second coaxial cables 42, 44 having respectively inner conductors 46, 48 and outer conductors 50, 52. The inner conductor 46 of the first coaxial cable 42 extends between a sum port 54 and the inner conductor 32 of the first output port 26, while the inner conductor 48 of the second coaxial cable 44 extends between the sum port 54 and the inner conductor 34 of the second output port 28.

Each of the first and the second coaxial cables 42, 44 are passed through a core 56 of magnetic material to minimize the effect of even mode impedances between the first and the second coaxial cables 42, 44 and the common ground plane 22. In other words, the core 56 inhibits the flow of current on the surfaces of the outer conductors 50, 52 of the first and the second coaxial cables 42, 44. The first and second coaxial cables 42, 44 are passed through core 56 in opposite directions so as to be flux canceling when in the coherent mode; it being understood that combiner 20 is inherently flux canceling when in the transmission line mode. Core 56 is preferably formed from a ferrite material, and may take the form of a toroid, a squaroid, or any of other numerous know appropriate shapes. A squaroid is preferred, however, because such a shape is relatively easy to heat sink.

The combiner 20 also includes third and fourth coaxial cables 58, 60 having respectively inner conductors 62, 64 and outer conductors 66, 68. The inner conductor 62 of the third coaxial cable 58 extends between a first end 70 of the outer conductor 50 of the first coaxial cable 42 and a second end 72 of the outer conductor 52 of the second coaxial cable 44, while the inner conductor 64 of the fourth coaxial cable 60 extends between a first end 74 of the outer conductor 52 of the second coaxial cable 44 and a second end 76 of the outer conductor 50 of the first coaxial cable 42. Both ends of the outer conductors 66, 68 of the third and the fourth coaxial cables 58, 60 are connected to the common ground plane 22.

The combiner 20 also includes first and second dissipaters 78, 80 for dissipating unbalanced power at the ports 26, 28. The first dissipater 78 extends between the first ends 70, 74 of the outer conductors 50, 52 of the first and the second coaxial cables 42, 44, while the second dissipater 80 extends between the second ends 72, 76 of the outer conductors 50, 52 of the first and the second coaxial cables 42, 44. Preferably, both of the first and the second dissipaters 78, 80 comprise isolation resistors as shown in FIG. 2. The combiner 20 can also be provided with grounded capacitors 82 connected at the sum port 54 and at each output port 26, 28, and with capacitors 84 in parallel with the first and the second dissipaters 78, 80. The capacitors 82, 84 compensate for any residual reactance within the combiner 20.

The combiner 20 provides a 1:2 impedance transformation between the sum port 54 and each output port 26, 28. If desired, a 2:1 impedance transformer (not shown) may be provided between input port 24 and sum port 54 so that the input impedance would be the same as the output impedance. In order to provide a standard 50 Ohm output impedance, the characteristic impedance of each coaxial cable 42, 44, 58, 60 is 25 Ohms, and the isolation resistors which preferably comprise dissipaters 78, 80 are each 50

Ohms. It should be understood, however, that other impedance and resistance values could be used if another output impedance is desired.

It should be understood that, as is commonly known in the art, the present invention may incorporate a circuit board (not shown) including the common ground plane 22 in the form of a plate of electrically conductive material, such as copper for example. The circuit board may also include a layer of insulating material, such as Teflon® for example, over the ground plane 22. When such is the case, coaxial cables 58, 60, which are connected to ground at both ends of their outer conductors 66, 68, may be printed on the circuit board instead of taking the form of coaxial cables.

Figure 3:
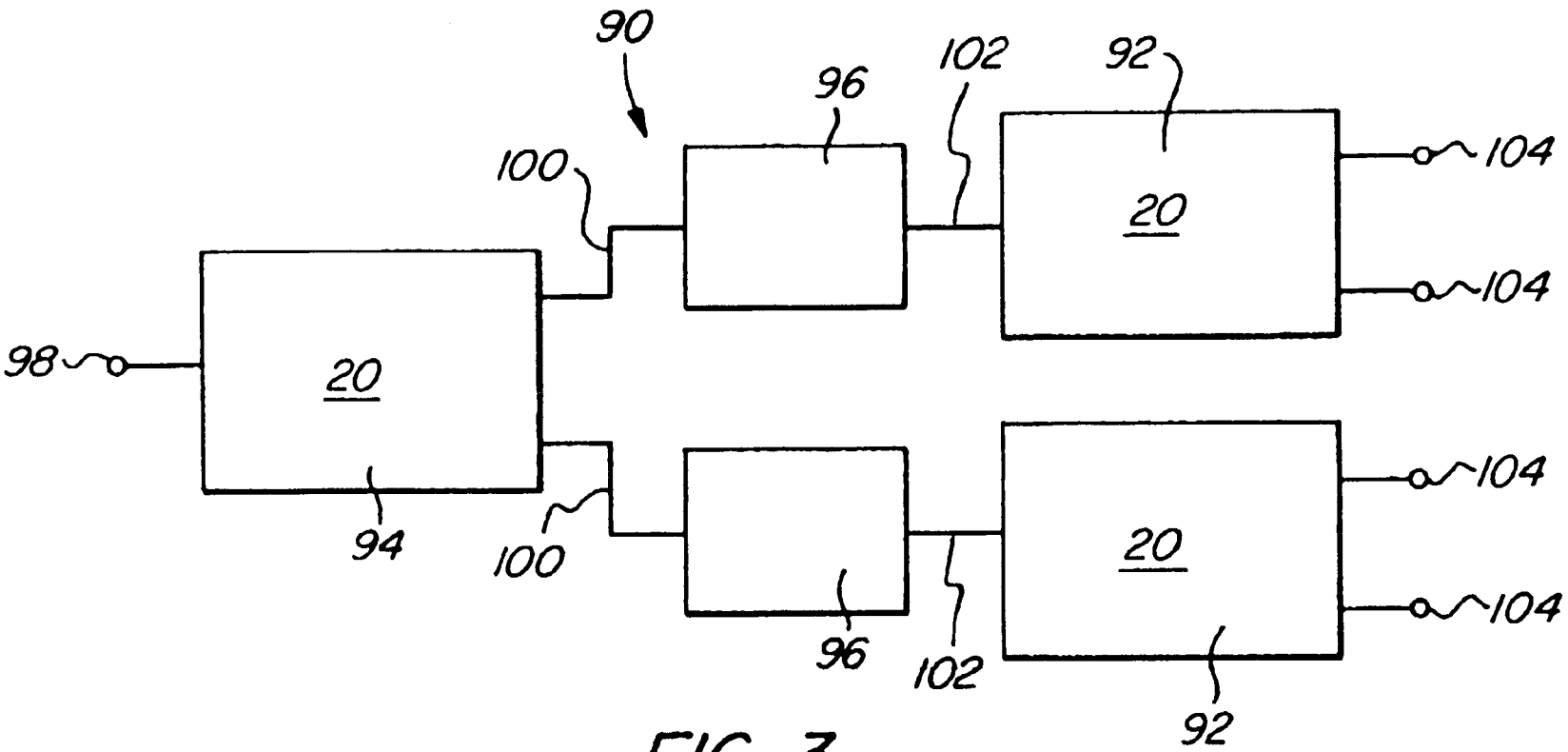
FIG. 3 is a block diagram of a 4-way combiner assembly in accordance with the present invention.

A 4-way non-directional combiner assembly 90 according to the present invention is shown in FIG. 3, and includes two 2-way combiners 92 of the type 20 shown in FIG. 2, cascaded with a third 2-port combiner 94 also of the type 20. Disposed between each combiner 92 and combiner 94 is a 4:1 impedance transformer 96. Preferably impedance transformers 96 comprise impedance transmission line transformers which are known and can be found, for example, in an article by G. Guanella entitled "Novel Matching Systems for High Frequencies," Brown-Boveri Review, Vol. 31, September 1944. Such a transformer is desirable because these transformers have virtually no flux in the core, which when combined with the flux canceling properties of combiner 20, provide a combiner assembly 90 having excellent IMD performance.

Combiner 94 is connected to an input port 98 as is described above with respect to the two-way combiner assembly 10. Instead of the output lines 100 of combiner 94 being connected to output ports, however, the output lines 100 are connected to the inputs of impedance transformers 96. The output lines 102 of impedance transformers 96 are in turn connected to combiners 92. Each of the outputs from combiners 92 are in turn connected to output ports 104, as is described above with respect to the two-way combiner assembly 10.

Typically, the input impedance at input port 98 will be 50 ohms. Since combiner 94 provides a 1:2 impedance transformation, the impedances at output lines 100 will be 100 ohms, which is transformed by 4:1 impedance transformers 96 to 25 ohms at output lines 102 of impedance transformers 96. Combiners 92 again provide a 1:2 impedance transformation, which transform the impedances at output ports 104 back to 50 ohms. Of course, it should be understood that the above impedance values are provided for example only, and other impedances can be provided.

Although not shown, the 4-way combiner assembly 90 may include a circuit board similar to the circuit board of the 2-way combiner assembly 10 described above, yet being necessarily larger to hold the three combiners 92, 94 and 4:1 impedance transformers 96.

The 4-way combiner assembly 90 according to the present invention surprisingly has been found to provide a frequency range of, for example, 10 MHz to 500 MHz: a 50:1 bandwidth. The combiner assembly 90 can also handle power up to 1 Kw cw. with linear performance and with little distortion. The combiner assembly 90 also performed at a typical insertion loss of less than 0.4 dB, an isolation between ports 104 of greater than 20 dB, and a voltage standing wave ratio at all ports 98, 104 of less than 1.2:1.

The present invention therefore provides a non-directional signal combiner which exhibits exceptional power handling ability with low insertion loss characteristics, which exhibits improved isolation characteristics between input ports, which exhibits excellent input and output port voltage standing wave ratio characteristics, which is capable of dissipating relatively large amounts of unbalanced power, which employs flux canceling circuitry combined with transmission line mode impedance matching which inherently exhibits excellent IMD characteristics, which exhibits a usable bandwidth of a decade or more and which is rugged and reliable, and of a relatively simple design that is conducive to relatively inexpensive mass production.

Although the invention has been described with reference to a particular arrangement of parts, features and the like, these are not intended to exhaust all possible arrangements or features, and indeed, many other modifications and variations will be ascertainable to those skilled in the art.

What is claimed is:

1. A signal combiner assembly comprising:

a common ground plane;

first and second coaxial cable connectors each having inner conductors and outer conductors, the outer conductors being connected to said common ground plane;

a sum port;

a first coaxial cable having an inner conductor and an outer conductor, the inner conductor extending between the inner conductor of said first coaxial cable connector and said sum port;

a second coaxial cable having an inner conductor and an outer conductor, the inner conductor extending between the inner conductor of said second coaxial cable connector and said sum port;

a first dissipater extending between the first ends of the outer conductors of said first and the second coaxial cables;

a second dissipater extending between the second ends of the outer conductors of said first and the second coaxial cables;

a piece of magnetic material having a hole passing therethrough, said first coaxial cable and said second coaxial cable passing through the hole in said piece of magnetic material from opposite sides of the hole;

a third coaxial cable having an inner conductor and an outer conductor, the inner conductor extending between a first end of the outer conductor of said first coaxial cable and a second end of the outer conductor of said second coaxial cable, both ends of the outer conductor of said third coaxial cable connected to said common ground plane; and a fourth coaxial cable having an inner conductor and an outer conductor, the inner conductor extending between a first end of the outer conductor of said second coaxial cable and a second end of the outer conductor of said first coaxial cable, both ends of the outer conductor of said fourth coaxial cable connected to said common ground plane.

2. A signal combiner assembly according to claim 1 wherein said piece of magnetic material comprises a piece of ferrite.

3. A signal combiner assembly according to claim 1 wherein said piece of magnetic material comprises a piece of magnetic material having the shape of a squaroid.

4. A signal combiner assembly according to claim 1 wherein said piece of magnetic material comprises a piece of magnetic material having the shape of a toroid.

5. A signal combiner assembly according to claim 1 wherein each of the first and the second dissipaters comprises a resistor.

6. A signal combiner assembly according to claim 1 further comprising a first capacitor connected in parallel with said first dissipater and a second capacitor connected in parallel with said second dissipater.

7. A signal combiner assembly according to claim 1 further comprising a first capacitor extending between said sum port and said ground plane, a second capacitor extending between the outer conductor of said first coaxial cable connector, and a third capacitor extending between the outer conductor of said second coaxial cable connector.

8. A signal combiner assembly comprising:

a common ground plane;

first, second and third coaxial cable connectors, each having inner conductors and outer conductors, the outer conductors being connected to said common ground plane;

a sum port connected to the inner conductor of said first coaxial cable connector;

a first coaxial cable having an inner conductor and an outer conductor, the inner conductor extending between the inner conductor of said second coaxial cable connector and said sum port;

a second coaxial cable having an inner conductor and an outer conductor, the inner conductor extending between the inner conductor of said third coaxial cable connector and said sum port; and a piece of magnetic material having a hole passing therethrough, said first coaxial cable and said second coaxial cable passing through the hole in said piece of magnetic material from opposite sides of said hole.

9. A signal combiner assembly according to claim 8 further comprising:

a first conductor extending between a first end of the outer conductor of the first coaxial cable and a second end of the outer conductor of the second coaxial cable; and a second conductor extending between a first end of the outer conductor of the second coaxial cable and a second end of the outer conductor of the first coaxial cable.

10. A signal combiner assembly according to claim 8 wherein said piece of magnetic material comprises a piece of ferrite.

11. A signal combiner assembly according to claim 10 wherein said piece of ferrite comprises a piece of ferrite having the shape of a squaroid.

12. A signal combiner assembly according to claim 10 wherein said piece of ferrite comprises a piece of ferrite having the shape of a toroid.

13. A signal combiner according to claim 8 further comprising:

a first dissipater extending between the first ends of the outer conductors of said first and said second coaxial cables; and a second dissipater extending between the second ends of the outer conductors of said first and said second coaxial cables.

14. A signal combiner according to claim 13 wherein each of the first and the second dissipaters comprise a resistor.

15. A signal combiner assembly comprising:

a common ground plane;

an input coaxial cable connector having an inner conductor and an outer conductor, the outer conductor being connected to said common ground plane;

first, second, and third signal combiners, each of said signal combiners comprising:

a sum port;

first and second output ports;

a first coaxial cable having an inner conductor and an outer conductor, the inner conductor extending between said first output port and said sum port;

a second coaxial cable having an inner conductor and an outer conductor, the inner conductor extending between said second output port and said sum port; and a piece of magnetic material having a hole passing therethrough, said first coaxial cable and said second coaxial cable passing through the hole in said piece of magnetic material from opposite sides of said hole;

wherein said sum port of said first signal combiner is connected to said input coaxial cable connector;

a first impedance transformer connected between the first output port of said first signal combiner and the sum port of said second signal combiner;

a second impedance transformer connected between the second output port of said first signal combiner and the sum port of said third signal combiner; and, four output coaxial cable connectors, each having an inner conductor and an outer conductor, the outer conductors being connected to said common ground plane, the inner conductor a first of said output connectors being connected to the first output port of said second signal combiner, the inner conductor of a second of said output connectors being connected to the second output port of said second signal combiner, the inner conductor of a third of said output connectors being connected to the first output port of said third signal combiner, and the inner conductor of a fourth of said output connectors being connected to the second output port of said third signal combiner.

16. A signal combiner assembly according to claim 15 wherein each of said signal combiners further comprises:

a third coaxial cable having an inner conductor and an outer conductor, the inner conductor extending between a first end of the outer conductor of said first coaxial cable and a second end of the outer conductor of said second coaxial cable, both ends of the outer conductor of said third coaxial cable connected to said common ground plane; and a fourth coaxial cable having an inner conductor and an outer conductor, the inner conductor extending between a first end of the outer conductor of said second coaxial cable and a second end of the outer conductor of said first coaxial cable, both ends of the outer conductor of said fourth coaxial cable connected to said common ground plane.

17. A signal combiner assembly according to claim 15 wherein said piece of magnetic material comprises a piece of ferrite.

18. A signal combiner assembly according to claim 15 wherein said piece of ferrite comprises a piece of ferrite having the shape of a squaroid.

19. A signal combiner assembly according to claim 15 wherein said piece of ferrite comprises a piece of ferrite having the shape of a toroid.

20. A signal combiner according to claim 15 wherein each of said signal combiners further comprises:

a first dissipater extending between the first ends of the outer conductors of said first and said second coaxial cables; and a second dissipater extending between the second ends of the outer conductors of said first and said second coaxial cables.

21. A signal combiner according to claim 20 wherein each of the first and the second dissipaters comprises a resistor.

* * * * *